United States Patent [19]

Gaastra

[11] 3,935,619

[45] Feb. 3, 1976

[54] GRUMMENT FOR SAIL CLOTH

[75] Inventor: Douwe Gaastra, Heeg, Netherlands

[73] Assignee: Gaastra B.V., Sneek, Netherlands

[22] Filed: Mar. 31, 1975

[21] Appl. No.: 563,312

Related U.S. Application Data

[62] Division of Ser. No. 351,481, April 16, 1973, Pat. No. 3,890,695.

[52] U.S. Cl. ..... 24/141; 114/115

[51] Int. Cl.[2] ..... A43C 5/00; B63H 9/08

[58] Field of Search ..... 24/141, 202, 265 EE; 114/115; 29/512

[56] References Cited

UNITED STATES PATENTS

| | | | |
|---|---|---|---|
| 2,393,984 | 2/1946 | Gookin | 24/141 |
| 2,553,051 | 5/1951 | Kingman | 24/141 X |
| 2,633,618 | 4/1953 | Moe | 24/202 |
| 3,399,435 | 9/1968 | Ackerman | 24/141 |
| 3,450,810 | 6/1969 | Lagarde | 24/265 EE UX |
| 3,512,224 | 5/1970 | Newton | 24/141 |
| 3,653,353 | 4/1972 | Davis | 114/115 |

*Primary Examiner*—Donald A. Griffin
*Attorney, Agent, or Firm*—Robert F. O'Connell

[57] ABSTRACT

A grumment for sail cloth in which two rings are positioned around the edge of a hole therein which edge has been ravelled and has a thermosetting adhesive smeared thereon and tightly clamped against the edge by a torus-shaped collar enclosing the rings.

3 Claims, 4 Drawing Figures

GRUMMENT FOR SAIL CLOTH

This is a division of application Ser. No. 351,481, filed on Apr. 16, 1973, and now U.S. Pat. No. 3,890,695, issued June 24, 1975.

The invention relates to a method of inserting a grummet or thimble in sail cloth or the like consisting of positioning two rings each at one side of the sail cloth around the edge of the hole and interconnecting both rings with the edge of the hole therebetween by pression. Grummets or thimbles serve for instance as points of attachment for the sheets and the like in the corners of a sail of sailing boats or as points of attachment for lace or reef lines.

The prior art grummets consist of rings which are sewn in the sail cloth, the prior art thimbles consist of two specially formed rings which are pressed to one ring around the hole in the sail cloth.

The invention aims at providing a method of forming a grumeet or thimble which is connected to the sail cloth in such a manner that each risk of tearing is excluded, it can be inserted in considerably less time than the prior art grummet and is considerably stronger than the prior art thimble. This aim is achieved according to the invention in that after making the hole in the sail cloth or the like the edge of the hole is ravelled out, the edge of the hole is smeared with a setting glue, preferably an epoxy glue, so that a glue smeared hole edge is formed, a short tube is disposed in the die of a punch which tube preferably consists of stainless steel and has a diameter which fits into the hole, of which tube the lower end is somewhat flanged outwardly, one of the two rings which is preferably of aluminium is disposed around this tube so that it rests on the outwardly flanged lower end of the tube, the sail cloth or the like is placed around the tube on the said one ring, the second identical ring is placed around the tube, the tube is so deformed with the stamp of the punch that it obtains a torus-shaped configuration whereby the two rings clamp between them and compress both the sail cloth and the edge, whereupon the sail cloth together with the grummet or thimble is removed from the punch. After setting the grummet or thimble is at full strength.

Due to the fact that after the punching operation the edge forms a hard thickened rim which is entirely enclosed between the two rings and the tube which has been bent in the form of a torus an extremely strong connection between the grummet or thimble and the sail cloth is obtained.

In a preferred embodiment of the method according to the invention the stamp of the punch, with a view of the removal of the sail cloth together with the grummet or thimble from the punch, is built up of two disengageable parts, the upper part of the stamp, after pressing the grummet or thimble, being removed from the lower part, the lower part being laid on an anvil in such a manner that the bottom side of the die is not supported and the grummet or thimble being pressed on or struck in order to move the die relative to the lower part of the stamp to discontinue the wedging action between the grummet or thimble and the stamp.

The invention also relates to a punch for carrying out the method according to the invention as well as to a sail for a vessel, tarpaulin or the like which is provided with at least one grummet or thimble inserted with the method and/or the punch according to the invention.

The invention will now be further explained with reference to the drawing in which:

FIG. 1 is plan view of a grummet or thimble according to the invention inserted in an opening in a sail or the like;

FIG. 4 shows a longitudinal section through a punch for inserting the grummet or thimble according to FIGS. 1 and 2 in a sail or the like.

Like every grummet or thimble, the grummet or thimble according to the invention in plan view has the configuration of a ring which is disposed around the edge of a round opening in the sail cloth which is indicated at 1.

Figure 3:
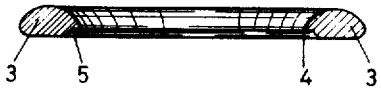
FIG. 3 is a cross-section through a ring.

In one way or another a round hole is made in the sail cloth. The edge of this round hole is ravelled out for instance by means of a rotary steel wire brush. Thereupon this ravelled edge is smeared with an epoxy glue or the like. After the punching operation this glue sets to a thickned rim indicated at 2. On the rim, above or below the sail cloth 1, a ring 3 of aluminium or the like is laid. This ring 3 is flat on one side and has a circular cross-section at the other side. At the inner side of the ring 3 an edge has been removed. This edge has a boundary surface 4 parallel to the plane of the ring and a boundary surface 5 which tapers outwardly from the boundary surface 4 as shown in FIG. 3.

The edges formed by these boundary surfaces serve to receive the glue rim 2 of the sail cloth 1. Around the two identical rings 3 and the rim 2, starting from a cylindrical, preferably stainless steel tube, a collar 6 is clamped, as illustrated in FIG. 1.

Figure 1:
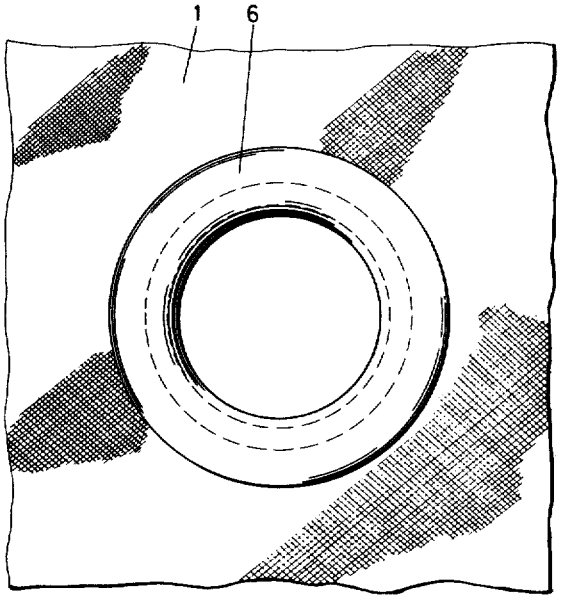
Figure 2:
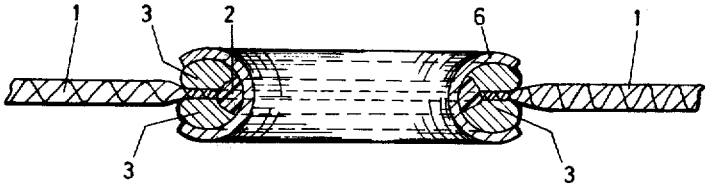
FIG. 2 is a cross-section along the line II—II in FIG. 1.
Figure 4:
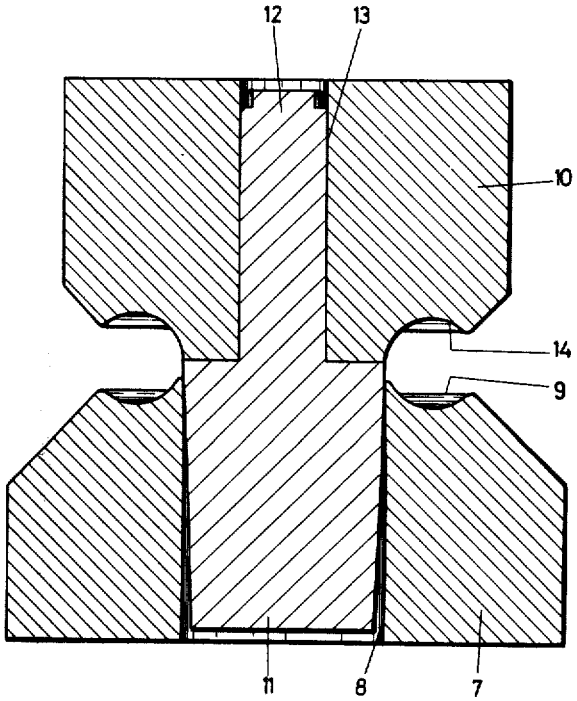

The insertion of the grummet or thimble according to FIGS. 1 and 2 occurs in a punch which is illustrated in FIG. 4.

The punch comprises a die 7 having a central opening 8 and an upwardly facing channel-shaped recess 9. A stamp consisting of an upper part 10 and a lower part 11, the so-called nipple, cooperates with the die 7. The nipple 11 has a threaded portion 12 which has been screwed into a threaded opening 13 in the upper stamp part 10.

The nipple 11 slightly tapers downwardly.

The upper part 10 of the stamp, as also the die 7, is provided with a downwardly facing channel-shaped recess 14.

The operation of punching the grummet in the punch according to FIG. 4 takes place as follows:

The stamp is removed from the die.

The cylindrical stainless steel tube with its slightly outwardly flanged lower end is deposited in the channel-shaped recess 9 of the die 7. Hereon the lower ring 3 of the grummet or thimble is placed. Thereupon the glue rim 2 of the opening in the sail cloth is placed in the removed edge of the ring and on top of this the upper ring is placed.

Subsequently the stamp is inserted in the die and moved downwardly relative to the die.

The cylindrical tube is deformed to the collar 6 which tightly clamps the rings 3 against the rim 2. Hereby the grummet has been formed.

Now the sail cloth together with the grummet or thimble must still be removed from the punch. To this end first the upper part 10 of the stamp is unscrewed from the nippel 11 which is wedged in the grummet. Subsequently the nipple is placed on an anvil with the lower edge of the die 7 being no longer supported. By now striking or pressing on the grummet and thence on the die the grummet together with the die moves downwardly relative to the nipple until the wedging action due to the conicity of the nipple has been discontinued. The sail cloth with the grummet is then free from the punch.

In this manner all the grummets in a sail of for instance a sailing vessel can be inserted.

It is clear that the method according to the invention can be applied in all sorts of domains, for instance in tarpaulins.

I claim:

1. A grummet assembly for use in a material, such as sail cloth or the like, comprising there being an opening in said material, the edge of said opening being ravelled and having a thermosetting adhesive smeared thereon;

a first ring having an inner diameter substantially the same as said opening in contact with one side of said material at the edge of said opening;

a second ring having an inner diameter substantially the same as said opening in contact with the other side of said material at the edge of said opening;

a torus-shaped collar enclosing said rings and the edge of said opening so as to tightly clamp said edge between said rings.

2. A grummet assembly in accordance with claim 1 wherein each of said rings has a flat surface on one side and a rounded surface having a substantially circular cross-section on the opposite side, said one side further having a recess on the inner perimeter thereof, the edge of said material being received by said recess.

3. A grummet assembly in accordance with claim 2 wherein said recess has a first boundary surface parallel to the plane of the flat surface of said ring and a second boundary surface which tapers outwardly from said first boundary surface.

* * * * *